US010974738B2

(12) United States Patent
Schneider et al.

(10) Patent No.: US 10,974,738 B2
(45) Date of Patent: Apr. 13, 2021

(54) GRATING

(71) Applicant: Eaton Intelligent Power Limited, Dublin (IE)

(72) Inventors: Jared A. Schneider, Bethalto, IL (US); Boyd F. Niesen, O'Fallon, IL (US); Robert W. Hall, Charlotte, NC (US); Jerid Stevenson, Pinckneyville, IL (US)

(73) Assignee: Eaton Intelligent Power Limited, Dublin (IE)

( * ) Notice: Subject to any disclaimer, the term of this patent is extended or adjusted under 35 U.S.C. 154(b) by 11 days.

(21) Appl. No.: 16/100,994

(22) Filed: Aug. 10, 2018

(65) Prior Publication Data

US 2020/0047775 A1 Feb. 13, 2020

(51) Int. Cl.
*B61D 17/12* (2006.01)
*B61D 17/14* (2006.01)

(52) U.S. Cl.
CPC ..... *B61D 17/12* (2013.01); *B61D 17/14* (2013.01)

(58) Field of Classification Search
CPC ..... B61D 17/12; B61D 17/14
See application file for complete search history.

(56) References Cited

U.S. PATENT DOCUMENTS 937,415 A * 10/1909 Cairns ..... B60R 3/002 280/169
1,343,281 A * 6/1920 Reisinger ..... B61D 17/14 105/457
1,827,450 A * 10/1931 Abel ..... B61D 17/14 105/457
2,091,157 A * 8/1937 Moorman ..... B61D 17/14 105/457
2,278,554 A * 4/1942 Morton ..... B61D 23/00 404/21
2,279,756 A * 4/1942 Lieberman ..... B61D 17/14 105/457
2,326,963 A * 8/1943 Morton ..... B61D 23/00 52/180
3,181,440 A * 5/1965 Mullaney ..... B21D 47/005 105/457
D258,465 S * 3/1981 Studinski ..... D25/142
4,749,191 A * 6/1988 Gipson ..... B60R 3/00 280/164.2
D365,544 S * 12/1995 Snyder ..... D12/203
5,611,285 A * 3/1997 Saxton ..... B61D 3/184 105/355
5,735,155 A 4/1998 Morton et al.
(Continued)

*Primary Examiner* — Babajide A Demuren
(74) *Attorney, Agent, or Firm* — Stinson LLP

(57) ABSTRACT

A grating for a support structure includes a piece of metal including a perimeter edge and a surface bound by the perimeter edge. The piece of metal defines an array of uniform surface modifications on the surface of the piece of metal. The uniform surface modifications are arranged in a repeated pattern across the surface. The repeated pattern of uniform surface modifications is consistent across the surface but for at least a pair of spaced apart areas of inconsistency where the uniform surface modifications are not formed in the surface. Each area of inconsistency is surrounded on all sides by the array of uniform surface modifications. The pair of areas of inconsistency provides an indication of where to attach a structure to the grating.

25 Claims, 8 Drawing Sheets

(56) References Cited

U.S. PATENT DOCUMENTS

| | | | | | |
|---|---|---|---|---|---|
| 6,145,861 | A * | 11/2000 | Willis | B60D 1/06 | 280/163 |
| 6,722,177 | B1 * | 4/2004 | Walsh | B21D 22/04 | 428/604 |
| 7,089,870 | B2 * | 8/2006 | Perry, Jr. | B61D 17/14 | 105/457 |
| 7,401,560 | B2 * | 7/2008 | McCrary | B61D 17/14 | 105/457 |
| D594,564 | S * | 6/2009 | Disch | D25/69 | |
| 7,849,962 | B2 * | 12/2010 | Barbara | E06C 5/02 | 105/443 |
| 9,156,405 | B1 * | 10/2015 | Levesque | B60R 3/00 | |
| D745,924 | S * | 12/2015 | Trifilio | D17/20 | |

* cited by examiner

GRATING

FIELD OF THE DISCLOSURE

The present disclosure generally relates to grating, and more particularly, to a grating or running board for a support surface of a structure and a method of making a grating/running board.

BACKGROUND OF THE DISCLOSURE

Railway freight cars have been used for many years to transport materials across the railways. Roofs of the freight cars typically include a platform or decking that extends along the roof. Grating has application in a variety of industries and is commonly used in the railcar industry, and referred to as running boards, to provide the structure for the roof decking. Running boards are pieces of metal that can be attached to and partially define the roof of a rail car. The running boards provide a frictional support surface for an individual to walk on when they are on the roof of the rail car. Grating may also be used as platforms or decking in industries outside the railcar industry. For example, in the automotive transportation, oil refinery, and construction industries grating is used for various support surfaces.

Referring to FIGS. 1A-1C, a running board assembly of the prior art is indicated generally at 1. The running board assembly 1 comprises a running board 3 and a grab iron 5 attached to the running board. The running board 3 comprises a sheet of metal defining an array of holes 7. Fasteners 9 attach the grab iron 5 to the running board 3 by extending through the holes 7 in the sheet. Washers 10 are disposed around the fasteners 9, above and below the running board 3, to provide a flat surface for the fasteners 9 and nuts 11 to engage so that the grab iron 5 can be securely attached to the running board. The location for placement of the grab iron 5 on the running board 3 is typically standardized for railcars. Reference can be made to AAR Manual of Standards and Recommended Practices Car Construction Fundamentals and Details, Section C, Standard S-2044 which describes the standardized dimensions for placement of roof handholds on a rail car. In order to properly locate the grab iron 5 on the running board 3, an installer must measure from edges of the running board 3 to determine which holes 7 to insert the fasteners 9. This measurement step introduces the possibility of assembly error by the installer.

SUMMARY OF THE DISCLOSURE

In one aspect, a grating for a support structure generally comprises a piece of metal including a perimeter edge and a surface bound by the perimeter edge. The piece of metal defines an array of uniform surface modifications on the surface of the piece of metal. The uniform surface modifications are arranged in a repeated pattern across the surface. The repeated pattern of uniform surface modifications is consistent across the surface but for at least a pair of spaced apart areas of inconsistency where the uniform surface modifications are not formed in the surface. Each area of inconsistency is surrounded on all sides by the array of uniform surface modifications. The pair of areas of inconsistency provides an indication of where to attach a structure to the grating.

In another aspect, a grating assembly for a support structure generally comprises a grating comprising a piece of metal including a perimeter edge and a surface bound by the perimeter edge. The piece of metal defines an array of uniform surface modifications on the surface of the piece of metal. A structure is attached to the grating by at least one fastener. The at least one fastener extends through an area of the surface that is not occupied by the array of uniform surface modifications.

In yet another aspect, a method of forming a grating for a support structure generally comprises placing a piece of metal into a device. Creating an array of uniform surface modifications in the piece of metal using the device such that the uniform surface modifications are arranged in a repeated pattern across a surface of the piece of metal. The repeated pattern of uniform surface modifications is consistent across the surface but for at least a pair of spaced apart areas of inconsistency where the uniform surface modifications are not formed in the surface. Each area of inconsistency is surrounded on all sides by the array of uniform surface modifications. The pair of areas of inconsistency provides an indication of where to attach a structure to the grating.

In still another aspect, a method of forming a grating assembly for a support structure generally comprises providing a grating comprising a piece of metal including a perimeter edge and a surface bound by the perimeter edge. The piece of metal defines an array of uniform surface modifications on the surface of the piece of metal. Locating a structure over the grating adjacent an area of the surface that is not occupied by the array of uniform surface modifications. Attaching the structure to the grating with at least one fastener in the area of the surface that is not occupied by the array of uniform surface modifications. The at least one fastener extends through the area of the surface that is not occupied by the array of uniform surface modifications.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

Figure 1A:
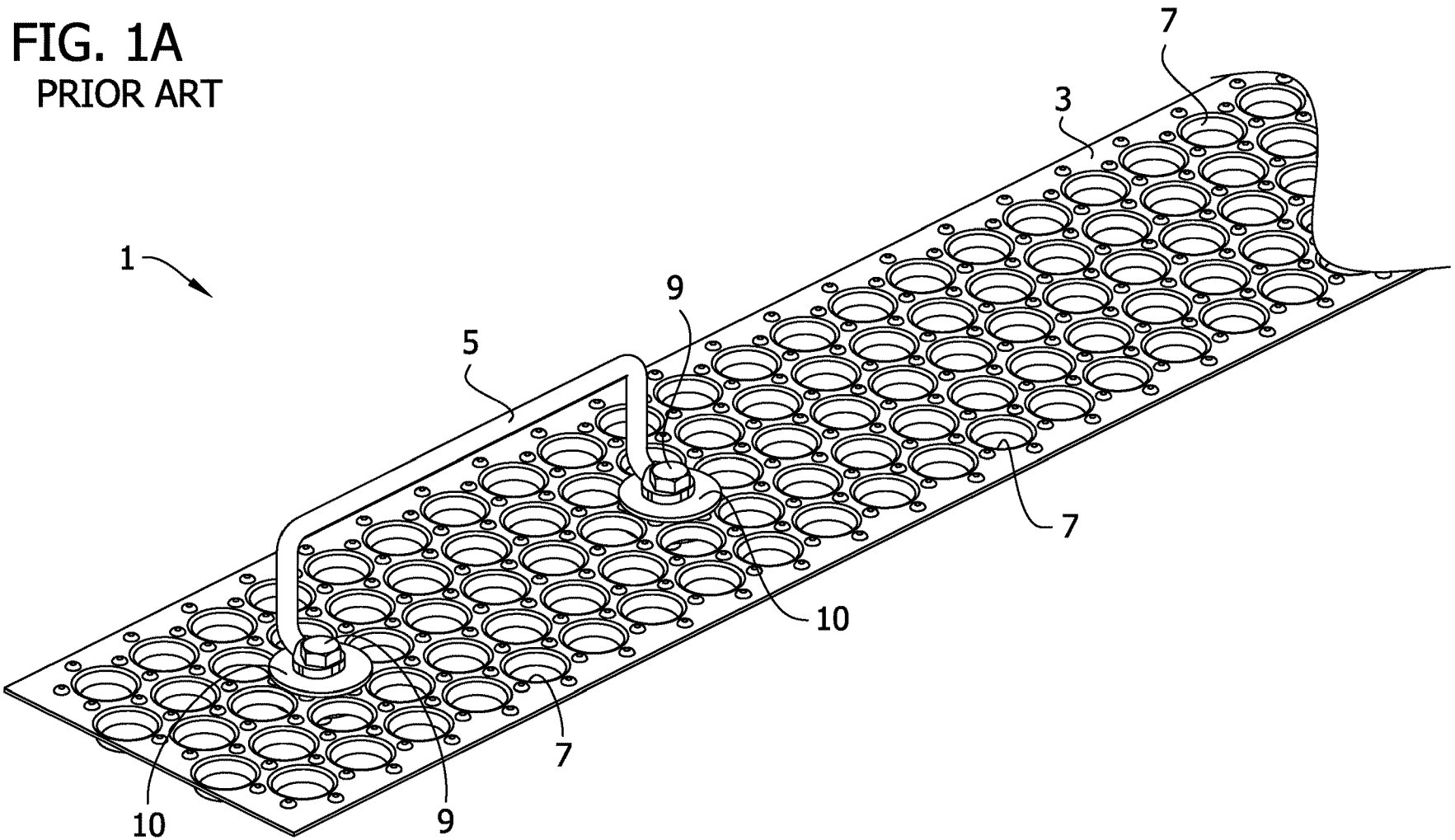
FIG. 1A PRIOR ART
FIG. 1A is a fragmentary top perspective of a running board assembly of the prior art.
Figure 1B:
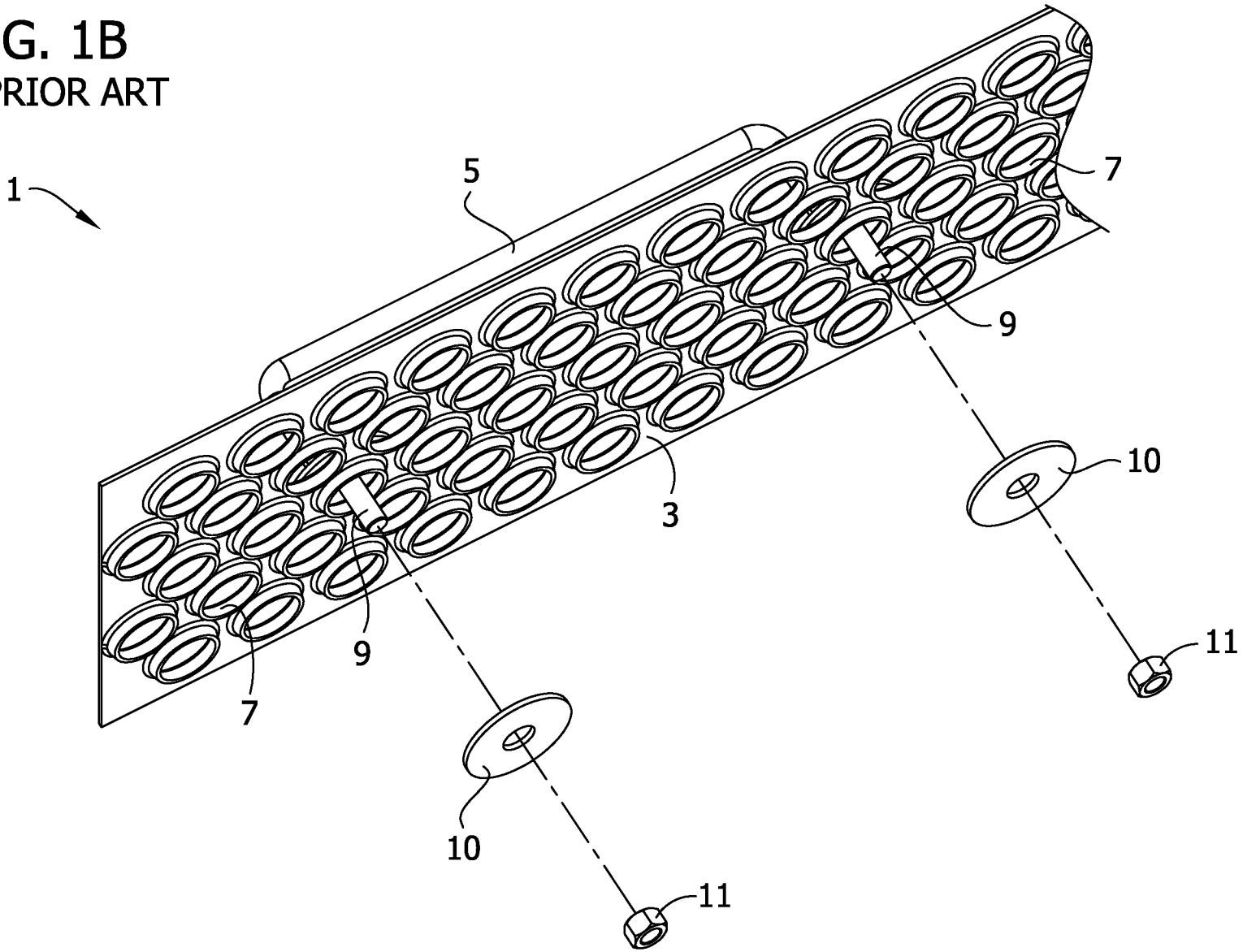
FIG. 1B PRIOR ART
FIG. 1B is a fragmentary bottom perspective of the running board assembly of the prior art.
Figure 1C:
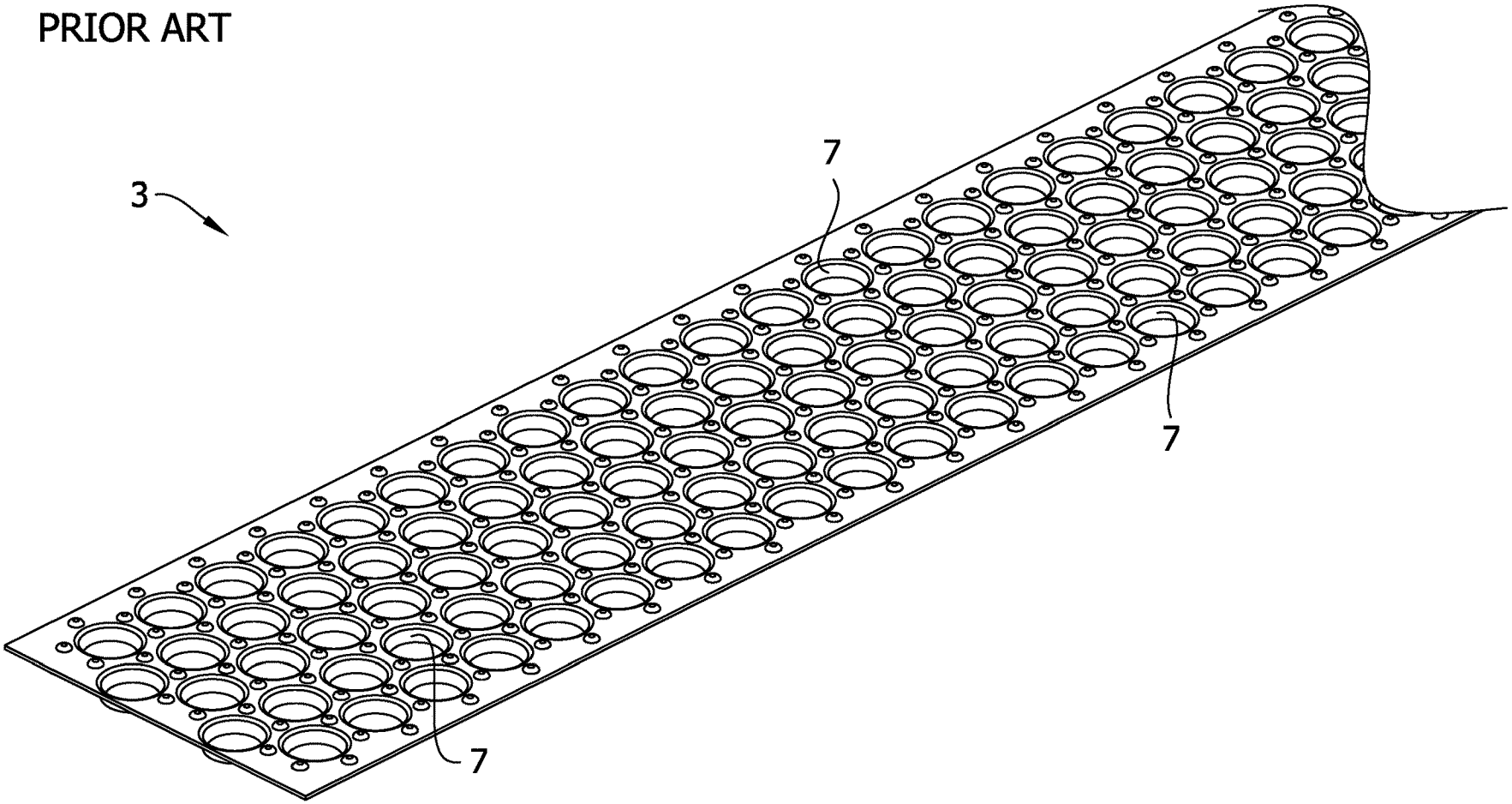
FIG. 1C PRIOR ART
FIG. 1C is a fragmentary perspective of a running board of the prior art.
Figure 2:
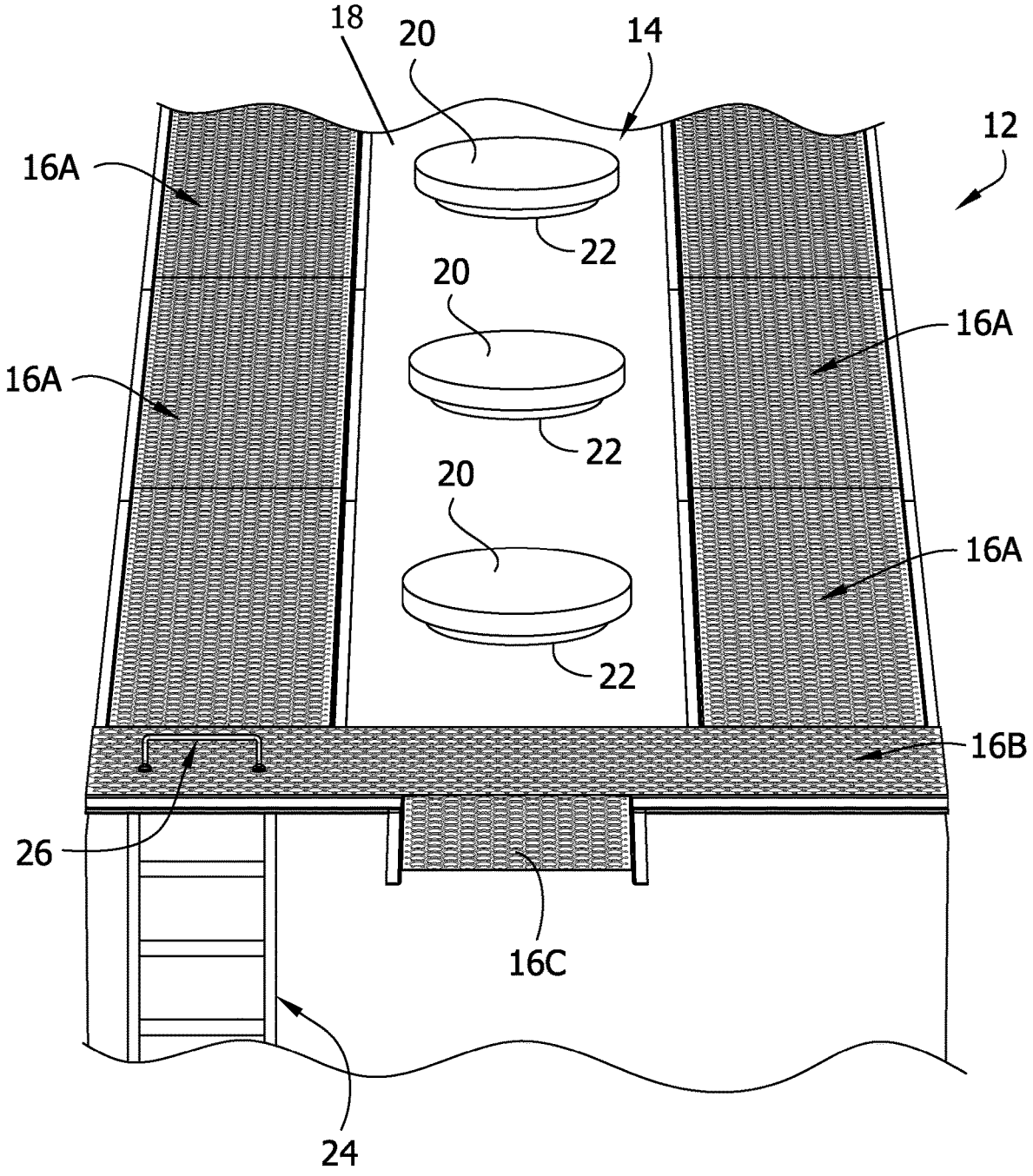
FIG. 2 is an illustration of a rail car showing a roof of the rail car.

Referring now to the drawings and in particular to FIG. 2, a railcar is generally indicated at reference numeral 12. In the illustrated embodiment, the railcar is a covered hopper car. A roof of the railcar 12 is generally indicated by reference number 14 and is partially defined by a plurality of running boards 16 extending along a perimeter edge margin of the roof. In the illustrated embodiment, running boards of different shapes and configurations are used. Longitudinal running boards 16A are disposed in an end to end fashion along the longitudinal sides of the roof 14. The longitudinal boards 16A are generally rectangular in shape. The number of longitudinal running boards 16A will vary depending on the size of the running board and the length of the railcar 12. Along each laterally extending end of the roof 14 (only one end is shown), a latitudinal board 16B is disposed. A single latitudinal board 16B extends across the lateral width of the roof 14 at each end of the railcar 12. The latitudinal boards 16B have a rectangular shape. The latitudinal boards 16B can have other configurations without departing from the scope of the disclosure. For example, the latitudinal boards can have a bridged construction including a pair of flat side portions and a raised center portion. The raised center portion would be configured to provide a clearance space for the contour of the top of the railcar 12. Also, multiple latitudinal boards can be used at each end of the railcar 12 without departing from the scope of the disclosure. Extension boards 16C extend from a center portion of the latitudinal boards 16B. The extension boards 16C are generally rectangular in shape. The running boards 16 form a decking or platform on the roof 14 that the individual can walk or stand on once they have climbed onto the roof. It will be understood, that the roof 14 could comprise other types of running boards having other arrangements without departing from the scope of the disclosure.

Figure 3:
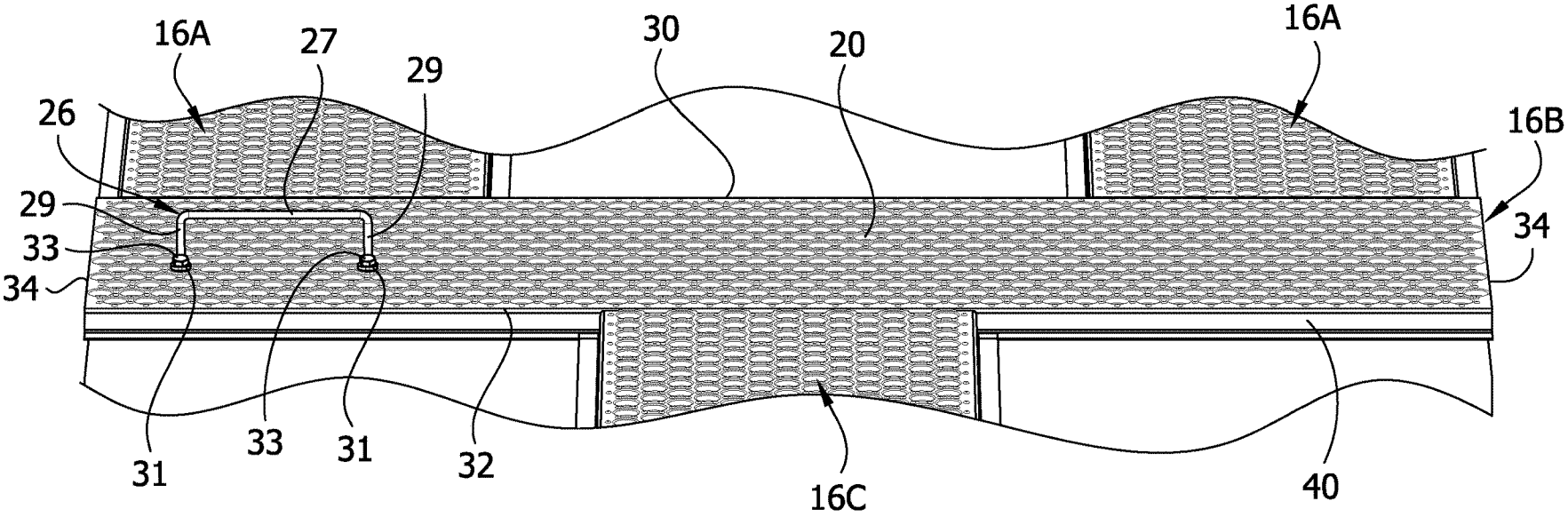
FIG. 3 is an enlarged fragmentary perspective of the roof of FIG. 2 showing a running board assembly.
Figure 4:
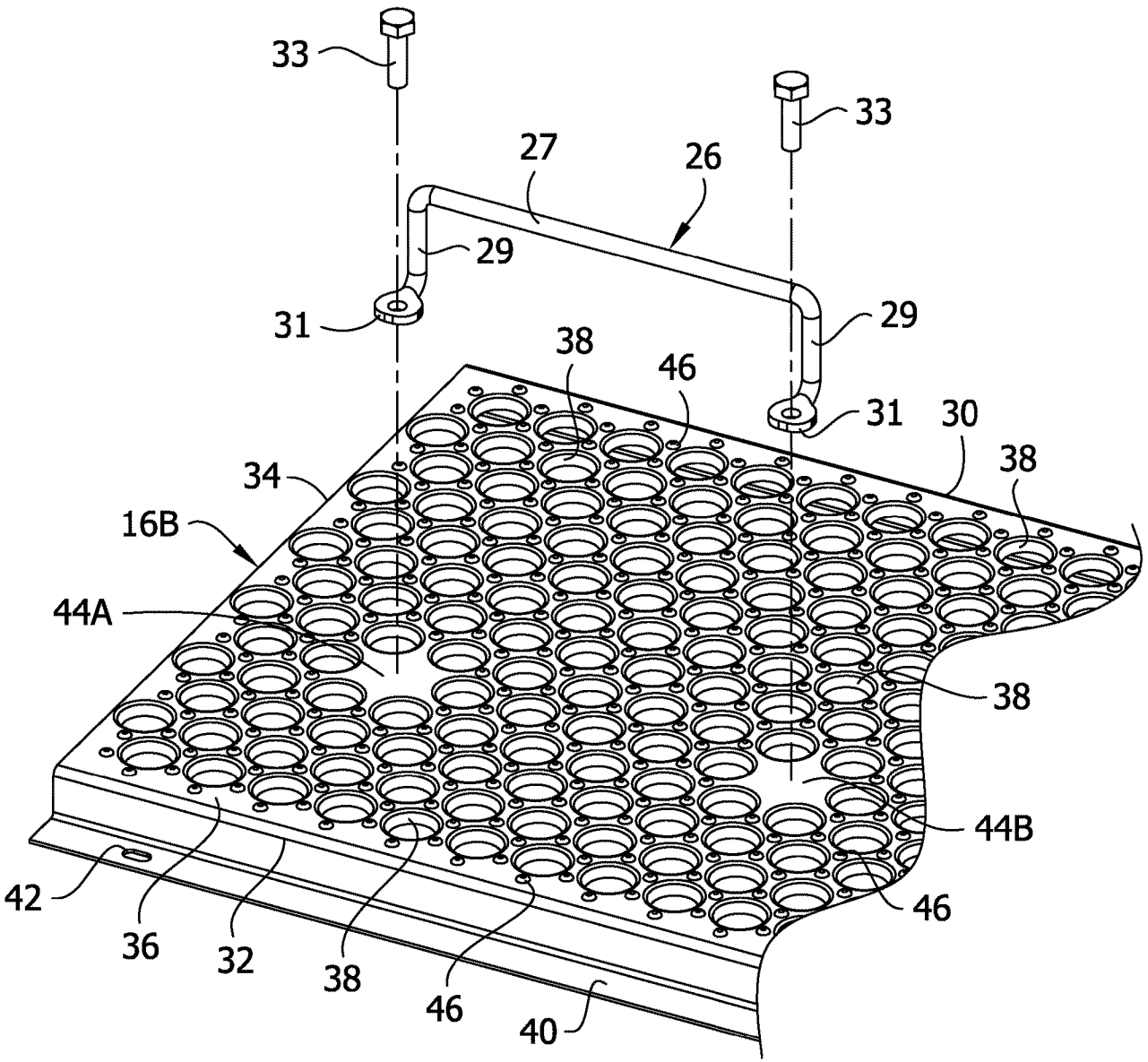
FIG. 4 is an exploded fragmentary view of the running board assembly in FIG. 3.

A central portion 18 of the roof 14 includes a plurality of hatch covers 20 that are removably attached to respective ports 22 formed in the roof. Removal of the hatch covers 20 expose openings of the ports 22 to provide access to an interior of the railcar 12. As can be readily understood, gaining access to the hatch covers 20 requires an individual to climb to the roof 14 of the rail car 10. A ladder 24 is provided on a side of the railcar 10 so that an individual can climb to the roof 14. In the illustrated embodiment, the grab iron 26 is attached to an end of the latitudinal running board 16B adjacent the ladder 24 so that the individual can grasp the grab iron to pull themselves onto the roof 14. In instances where the longitudinal running boards 16A extend to the ends of the roof 14, the grab iron 26 will be attached to a longitudinal running board. The grab iron 26 comprises a bar including an elongate arm 27 and attachment arms 29 extending laterally from opposite longitudinal ends of the elongate arm (FIGS. 3 and 4). Feet 31 extend laterally from the attachment arms 29 and have holes formed therein for receiving fasteners 33 for attaching the grab iron 26 to the running board 16B. The grab iron can have other configurations without departing form the scope of the disclosure. Broadly, the running board 16B and grab iron 26 are considered a grating or running board assembly.

Figure 5:
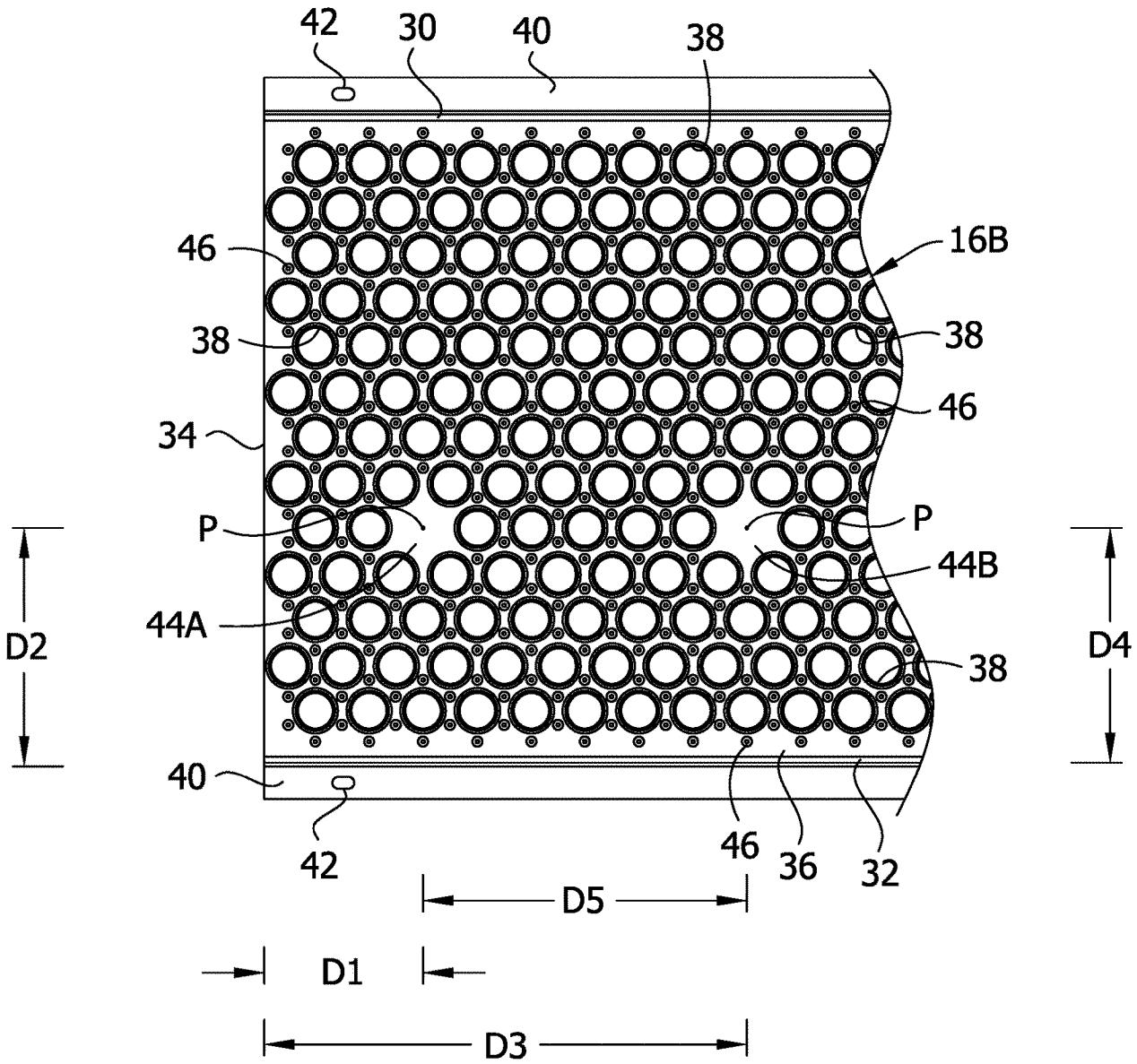
FIG. 5 is a top view of a portion of the running board assembly in FIG. 4 with a grab iron removed.

Referring to FIGS. 2-5, the running boards 16 comprise sheets of metal that can be attached to and partially define the roof 14 of the railcar 10. Running board 16B is shown in FIGS. 3-5 and includes a first side edge 30, a second side edge 32 opposite the first side edge and extending parallel to the first side edge, and opposing ends 34 extending between the first and second side edges. The ends 34 also define opposite parallel side edges. The first and second side edges 30, 32, and the ends 34 could also extend at non-parallel angles without departing from the scope of the disclosure. A surface 36 is bounded by and extends between the first side edge 30, second side edge 32, and opposing ends 34. Junctures between the side edges 30, 32 and the ends 34 define corners of the surface 36. In the illustrated embodiment, perforations of the running board 16B define a plurality of holes 38 in the surface 36. As shown, the holes 38 are circular. However, the holes 38 can have other shapes without departing from the scope of the disclosure. For example, the holes could have a diamond or rectangular shape. Additionally or alternatively, a surface modification other than a hole can be made on the surface 36 of the running board 16B. For example, ribs or other embossed features can be formed on the surface 36 of the running board 16B instead of holes. Flanges 40 extend laterally from the first and second side edges 30, 32. The flanges 40 include slots 42 spaced along the flanges for receiving fasteners for attaching the running board 16B to the top of the railcar 12.

As used herein, terms denoting relative locations and positions of components and structures, including but not limited to "top," "bottom," "left," "right," are in reference to the running board 16B in the horizontal orientation, as shown in FIGS. 3-5. It is understood that these terms are used for ease of description and not meant in a limiting sense.

The holes 38 in the surface 36 of the running board 16B are arranged in an array that extends substantially across the entire surface. The array comprises a repeated pattern of holes 38 that is substantially consistent across the entire surface 36. Alternatively, the repeated pattern of holes 38 may only extend across a portion of the surface 36. In the illustrated embodiment, the holes 38 are arranged in staggered parallel rows that extend across the running board 16B between the opposing ends 34. Other repeated patterns are also envisioned. In the illustrated embodiment, there are two areas of inconsistency 44 within the pattern of holes 38 where no hole 38 is present in the surface 36 of the running board 16B. These areas of inconsistency 44 are embedded within the pattern of holes 38 such that the areas are surrounded by holes on all sides. As can be seen in FIGS. 3-5, the areas of inconsistency 44 are located generally by the left end 34 and second (bottom) side edge 32 of the running board 16B. The areas of inconsistency 44 indicate to an installer where to locate the grab iron 26 on the running board 16B. The areas 44 also provide a flat surface for mounting the grab iron 26 to the running board 16B so that a secure connection can be made. In other embodiments, there may be only a single area of inconsistency or more than two areas of inconsistency depending on the particular application. The location and spacing of the areas of inconsistency may also vary depending on the application. Additionally, the areas of inconsistency may indicate to an installer where to locate structures other than a grab iron without departing from the scope of the disclosure. For example, an area of inconsistency may indicate where to locate a post or light standard on a grating or running board. Still other structures may be intended for attachment to the grating/running board.

Referring to FIG. 5, the areas of inconsistency 44 are aligned such that they are both disposed in one of the parallel rows of holes 38. This facilitates level mounting of the grab iron 26 to the running board 16B. In the illustrated embodiment, the areas 44 are disposed in the fifth row from the second (bottom) side 32 of the running board 16B. However, the areas 44 could be disposed in another row without departing from the scope of the disclosure. A first area 44A is disposed in the space where a third hole from the left end 34 in the row would have been formed but for the area of inconsistency. A second area 44B is disposed in the space where a ninth hole from the left end 34 in the row would have been formed. This generally disposes a center point P of the first area 44A a distance D1 between about 2 inches (5 cm) and about 14 inches (35 cm) from the left end 34 and a distance D2 between about 2 inches (5 cm) and about 22 inches (56 cm) from the second (bottom) side 32 of the running board 16B, and the second area 44B a distance D3 between about 5 inches (13 cm) and about 58 inches (147 cm) from the left end 34 and a distance D4 between about 2 inches (5 cm) and about 22 inches (56 cm) from the second (bottom) side 32 of the running board. In one embodiment, the first area 44A is no more than about 14 inches (35 cm) from the left end 34 and at least about 2 inches (5 cm) from the second (bottom) side 32 of the running board 16B, and the second area 44B is at least about 5 inches (13 cm) from the left end 34 and at least about 2 inches (5 cm) from the second (bottom) side of the running board. In one embodiment, the first area 44A is about 6 inches (15 cm) from the left end 34 and about 10 inches (25 cm) from the second (bottom) side 32, and the second area 44B is about 26 inches (66 cm) from the left end and about 10 inches (25 cm) from the second (bottom) side of the running board 16B. The center point P of the first area of inconsistency 44A may be disposed a distance D5 about 20 inches (51 cm) from a center point P of the second area of inconsistency 44B. This distance generally corresponds to the distance between the center points of the fastener holes in the feet 31 of the grab iron 26. In one embodiment, the distance between the center points P is at least about 3 inches (8 cm). In one embodiment, the distance D5 is between about 3 inches (8 cm) and about 36 inches (91 cm). The areas 44A, 44B could still have other locations without departing from the scope of the disclosure.

The running board 16B also includes a plurality of dimple holes 46 disposed around the holes 38. The surface 36 of the running board 16B around the dimple holes 46 is slightly raised above an adjacent area of the surface. The elevated surface around the dimple holes 46 provides an additional grip feature to the running board 16B so that the running board can be more safely walked on. In the illustrated embodiment, there are six dimple holes 46 disposed around each hole 38. The six dimple holes 46 are equally spaced around the circumference of the hole 38. Adjacent holes 38 may share dimple holes 46 with each other. The areas of inconsistency 44 are also free of any dimple holes 46. However, the dimple holes 46 could be disposed in the areas of inconsistency 44 without departing from the scope of the disclosure.

In the illustrated embodiment, each area of inconsistency 44 occupies the space of a single hole 38. However, each area 44 could occupy the space of more than one hole 38 without departing from the scope of the disclosure. For example, each area 44 could be sized to occupy the space of at least two holes 38 within a single row, or at least two holes in adjacent rows.

In the illustrated embodiment, the areas of inconsistency 44 are on the latitudinal boards 16B. However, as explained above, the longitudinal boards 16A could be arranged to extend to the ends of the roof 14 such that the areas of inconsistency 44 are formed in the longitudinal boards. In this instance, the spacing of the areas 44 would be based on the outside edge and longitudinal end of the longitudinal board 16A.

To assemble the running board assembly, the grab iron 26 is located adjacent the running board 16B. The feet 31 on the grab iron 26 are aligned with the areas of inconsistency 44 on the running board and fasteners 33 are inserted into the fastener holes in the feet and through the material in the areas of inconsistency 44 to attach the grab iron 26 to the running board 16B. A washer and nut (not shown) may be secured around each fastener on an underside of the running board 16B to secure the grab iron 26 to the running board. This process avoids having the installer measure the proper location to attach the grab iron 26 as the running board 16B comes equipped with an indicator that has already been properly measured and implemented into the design during the manufacture of the running board. Also, since the fasteners 33 that attach the grab iron 26 to the running board 16B are not extending through relatively large preformed holes in the running board but rather through a substantially flat portion of the material of the running board, the areas 44 eliminate the need to use a top washer to attach the grab iron. Instead, the feet 31 of the grab iron 26 can be seated against the flat surface of the areas 44 which provides a sound mechanical engagement between the grab iron and running board 16B. However, it is understood that washers could be used without departing from the scope of the disclosure. In one embodiment, a bottom washer is used to engage a bottom surface of the running board 16B. It is also envisioned that a top washer could be used.

Figure 6:
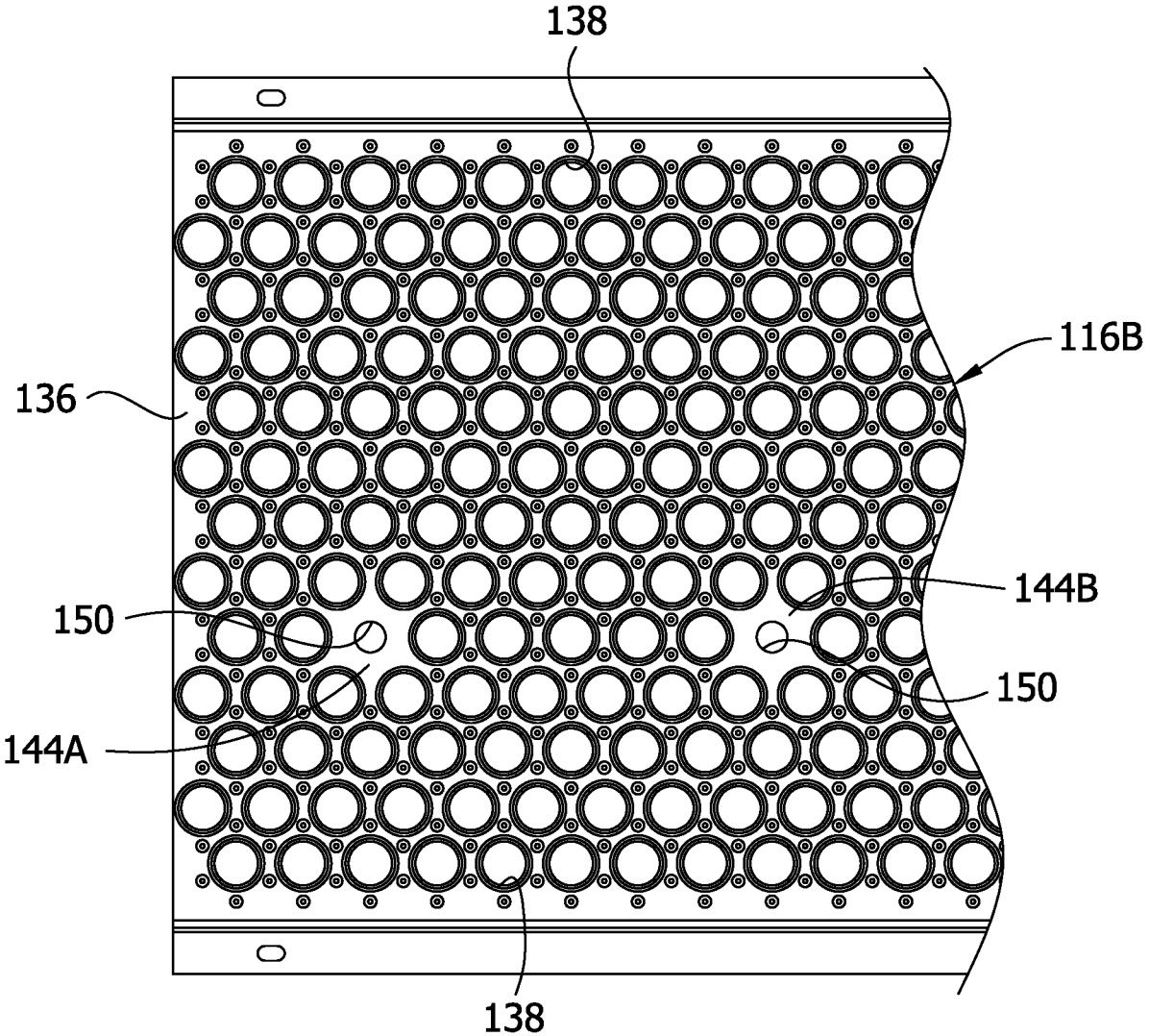
FIG. 6 is a top view of a portion of a running board of another embodiment.

Referring to FIG. 6, a running board of another embodiment is generally indicated at 116B. The running board of FIG. 6 is substantially the same as the running board 16B of the first embodiment except that areas of inconsistency 114A, 114B include fastener holes 150. The fasteners holes 150 are sized smaller and/or have a different shape than the holes 138 in the running board 116B. Thus, while the areas of inconsistency 144A, 144B include holes 150, they do not include the holes that correspond to the array of holes that extend across the surface 136 of the running board 116B. In the illustrated embodiment, the fastener holes 150 are circular. However, the fastener holes 150 could be slotted or have some other shape without departing from the scope of the disclosure. Additionally, in embodiments where the areas of inconsistency 114A, 114B occupy the space of more than one hole 138, the slotted fastener holes may also occupy the space of more than one hole.

In the manufacture of the running boards 16B, 116B, a die may be programmed to punch holes 38, 138 into a sheet or coil of metal in the arrangement shown in FIG. 5 or 6. Thus, rather than punching, forming, or otherwise creating the standard array of holes or other surface modifications where a pattern of holes/surface modifications is repeated across an entire die area, the die is programmed to leave the two areas un-punched which correspond to the areas of inconsistency 44, 144. The positions of the un-punched areas are programmed into the die so that no hole/surface modification is created in these areas. In the case of areas 144 in FIG. 6, a different sized fastener hole 150 is punched in each area of inconsistency in a later step in the manufacturing process. It is also envisioned that a die could be programmed to punch the fastener holes 150 in the same manner in which the holes 38 are punched.

In the manufacturing process, a sheet or coil of metal is placed into the die. The die then punches or otherwise creates an array of holes/surface modifications into the piece of metal. The die punches the holes or creates the surface modifications in a repeated pattern across a surface of the sheet/coil such that the pattern of holes/surface modifications is substantially consistent across the entire area of the surface. However, the program of the die skips areas in the pattern so that no hole is punched or surface modification is created. Therefore, during the manufacture of the grating/running board, the accurate placement of a grab iron can be ensured as the grating/running board will be formed with areas that indicate to the installer where to attach the grab iron. In the case of areas 144, the different sized fastener holes 150 within the areas will further indicate to the installer where to attach the grab iron.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A grating for a support structure comprising a piece of metal including a perimeter edge and a surface bound by the perimeter edge, the piece of metal defining an array of uniform surface modifications on the surface of the piece of metal, the uniform surface modifications being arranged in a repeated pattern across the surface, the repeated pattern of uniform surface modifications being consistent across the surface but for only a pair of spaced apart areas of inconsistency where the uniform surface modifications are not formed in the surface, each area of inconsistency being surrounded on all sides by the array of uniform surface modifications, the pair of areas of inconsistency providing an indication of where to attach a structure to the grating.

2. The grating of claim 1, wherein each area of inconsistency has a center point, the center points being spaced at least about 3 inches (8 cm) apart.

3. The grating of claim 1, wherein the perimeter edge is defined by first sides and second sides each extending between the first sides, at least one of the areas of inconsistency being located proximate a corner of the surface adjacent one of the first sides and one of the second sides.

4. The grating of claim 3, wherein said at least one of the areas of inconsistency is located no more than about 14 inches (35 cm) from said one of the first sides and at least about 2 inches (5 cm) from said one of the second sides.

5. The grating of claim 4, wherein another of the areas of inconsistency is located at least about 5 inches (13 cm) from said one of the first sides and at least about 2 inches (5 cm) from said one of the second sides.

6. The grating of claim 1, wherein the uniform surface modifications are arranged in parallel rows, the areas of inconsistency being disposed in one of said rows.

7. The grating of claim 1, wherein the array of uniform surface modifications comprise one of holes, ribs, or embossed features in the surface of the piece of metal.

8. The grating of claim 1, wherein the grating comprises a latitudinal running board configured to extend laterally across a top of a railcar.

9. The grating of claim 1, wherein the grating comprises a longitudinal running board configured to extend longitudinally along a top of a railcar.

10. The grating of claim 1, wherein each of the areas of inconsistency includes a fastener hole for receiving a fastener to attach the structure to the piece of metal.

11. The grating of claim 1, wherein each of the areas of inconsistency is free of any holes.

12. A grating assembly for a support structure comprising:

a grating comprising a piece of metal including a perimeter edge and a surface bound by the perimeter edge, the piece of metal defining an array of uniform surface modifications on the surface of the piece of metal; and a structure attached to the grating by at least one fastener such that the structure engages the surface of the piece of metal, the at least one fastener extending through an area of the surface that is not occupied by the array of uniform surface modifications, the area being surrounded on all sides by the array of uniform surface modifications, wherein the perimeter edge is defined by first sides and second sides each extending between the first sides, the structure comprising a grab iron attached to the grating, the grab iron comprising a bar for grasping the grab iron and a pair of openings receiving fasteners to attach the grab iron to the grating, the fasteners extending through areas of the surface that are not occupied by the array of uniform surface modifications.

13. The assembly of claim 12, wherein the fasteners are spaced at least about 3 inches (8 cm) apart.

14. The assembly of claim 12, wherein the grab iron is located proximate a corner of the surface adjacent one of the first sides and one of the second sides.

15. The assembly of claim 14, wherein one of the fasteners is located no more than about 14 inches (35 cm) from said one of the first sides and at least about 2 inches (5 cm) from said one of the second sides.

16. The assembly of claim 15, wherein the other of the fasteners is located at least about 5 inches (13 cm) from said one of the first sides and at least about 2 inches (5 cm) from said one of the second sides.

17. The assembly of claim 12, wherein the surface modifications are arranged in parallel rows, the structure being generally disposed in one of said rows.

18. The assembly of claim 12, in combination with a railcar, the grating assembly being attached to a top of the railcar and defining a portion of a roof of the railcar.

19. The combination of claim 18, wherein the grating comprises a latitudinal running board extending laterally across the top of the rail car.

20. The combination of claim 18, wherein the grating comprises a longitudinal running board extending longitudinally along the top of the rail car.

21. A method of forming a grating for a support structure comprising:

placing a piece of metal into a device;

creating an array of uniform surface modifications in the piece of metal using the device such that the uniform surface modifications are arranged in a repeated pattern across a surface of the piece of metal, the repeated pattern of uniform surface modifications being consistent across the surface but for only a pair of spaced apart areas of inconsistency where the uniform surface modifications are not formed in the surface, each area of inconsistency being surrounded on all sides by the array of uniform surface modifications, the pair of areas of inconsistency providing an indication of where to attach a structure to the grating.

22. The method of claim 21, wherein the device is programmed to automatically form the array of uniform surface modifications leaving the at least a pair of areas of inconsistency free of the uniform surface modifications.

23. A method of forming a grating assembly for a support structure comprising:

providing a grating comprising a piece of metal including a perimeter edge and a surface bound by the perimeter edge, the piece of metal defining an array of uniform surface modifications on the surface of the piece of metal;

locating a structure over the grating adjacent an area of the surface that is not occupied by the array of uniform surface modifications, the area being surrounded on all sides by the array of uniform surface modifications; and attaching the structure to the grating with at least one fastener in the area of the surface that is not occupied by the array of uniform surface modifications such that the structure engages the surface of the piece of metal, the at least one fastener extending through the area of the surface that is not occupied by the array of uniform surface modifications.

24. The grating of claim 1, wherein the array of uniform surface modifications comprise holes in the surface of the piece of metal, and wherein each of the areas of inconsistency includes a fastener hole for receiving a fastener to attach the structure to the piece of metal, the fastener hole being sized differently from the holes defining the uniform surface modifications.

25. The method of claim 21, wherein creating the array of uniform surface modifications comprises punching holes in the piece of metal using the device, the method further comprising punching holes in each area of inconsistency using the device.

* * * * *